US008674931B2

(12) United States Patent
Sun et al.

(10) Patent No.: US 8,674,931 B2
(45) Date of Patent: Mar. 18, 2014

(54) METHOD FOR UPDATING DISPLAY IMAGE OF ELECTROPHORETIC DISPLAY PANEL AND ELECTROPHORETIC DISPLAY APPARATUS USING THE SAME

(75) Inventors: Wei-Min Sun, Hsin-Chu (TW); Chi-Mao Hung, Hsin-Chu (TW); Yao-Jen Hsieh, Hsin-Chu (TW); Kai-Hong Wang, Hsin-Chu (TW); Hong-Zhang Lin, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 421 days.

(21) Appl. No.: 12/757,962

(22) Filed: Apr. 9, 2010

(65) Prior Publication Data

US 2010/0309193 A1 Dec. 9, 2010

(30) Foreign Application Priority Data

Jun. 3, 2009 (TW) ..... 98118406 A

(51) Int. Cl.
*G09G 3/34* (2006.01)

(52) U.S. Cl.
USPC ..... 345/107

(58) Field of Classification Search
USPC ..... 345/107, 214; 359/296
See application file for complete search history.

(56) References Cited

U.S. PATENT DOCUMENTS

| | | | | |
|---|---|---|---|---|
| 5,436,636 | A | 7/1995 | Nonoshita et al. | |
| 2005/0104826 | A1 * | 5/2005 | Baek et al. | 345/87 |
| 2005/0174340 | A1 * | 8/2005 | Jones | 345/204 |
| 2005/0270261 | A1 * | 12/2005 | Danner et al. | 345/84 |
| 2005/0285831 | A1 * | 12/2005 | Jones | 345/87 |
| 2006/0227253 | A1 | 10/2006 | Kim | |
| 2007/0206262 | A1 | 9/2007 | Zhou | |
| 2008/0316189 | A1 * | 12/2008 | Choi et al. | 345/107 |
| 2009/0115763 | A1 * | 5/2009 | Inoue | 345/211 |

FOREIGN PATENT DOCUMENTS

| | | | |
|---|---|---|---|
| CN | 1659618 | A | 8/2005 |
| CN | 101006491 | A | 7/2007 |
| JP | 2004302355 | A2 | 10/2004 |

* cited by examiner

*Primary Examiner* — Allison W Johnson
(74) *Attorney, Agent, or Firm* — WPAT, PC; Justin King

(57) ABSTRACT

A method for updating display image of an electrophoretic display panel and an electrophoretic display apparatus using the same are provided. In the aforementioned method, the gate lines of the electrophoretic display panel are divided into a first group and a second group. The display data related to pixels coupled to the gate lines of the first group need not to be updated. Furthermore, the display data related to at least one of the pixels coupled to the gate lines of the second group need to be updated. The first type gate pulses are provided to the gate lines of the first group respectively, and second type gate pulses are provided to the gate lines of the second group respectively. The second type gate pulse has a predetermined pulse width. The pulse width of the first type gate pulse is shorter than the predetermined pulse width.

20 Claims, 5 Drawing Sheets

METHOD FOR UPDATING DISPLAY IMAGE OF ELECTROPHORETIC DISPLAY PANEL AND ELECTROPHORETIC DISPLAY APPARATUS USING THE SAME

CROSS-REFERENCE TO RELATED APPLICATIONS

This application is based upon and claims the benefit of priority from the prior Taiwanese Patent Application No. 098118406, filed Jun. 3, 2009, the entire contents of which are incorporated herein by reference.

BACKGROUND

1. Field of the Invention

The present invention relates to the field of display apparatus and, more particularly, to a method for updating a display image of an electrophoretic display panel and an electrophoretic display apparatus using the same.

2. Description of Related Art

FIG. 1 is a schematic diagram of an electrophoretic display apparatus. Referring to FIG. 1, the electrophoretic display apparatus 100 comprises a timing controller 102, a source driver 104, a gate driver 106 and an electrophoretic display panel 108. The timing controller 102 is configured for receiving an image signal IN. The source driver 104 is coupled to the electrophoretic display panel 108 through the source lines $S_1$~$S_m$, and the gate driver 106 is coupled to the electrophoretic display panel 108 through the gate lines $G_1$~$G_n$, wherein m and n are natural numbers. The electrophoretic display panel 108 has a plurality of pixels (as indicated by the mark 110). Each of the pixels 110 is coupled to one of the source lines $S_1$~$S_m$ and is coupled to one of the gate lines $G_1$~$G_n$. In addition, each of the pixels 110 is further coupled to a common electrode voltage VCOM.

When a display image of the electrophoretic display panel 108 needs to be updated, the timing controller 102 controls the gate driver 106 to output gate pulses to the electrophoretic display panel 108 by the clock signal CKV and the control signal $CS_1$. FIG. 2 shows the mentioned gate pulses. Referring to FIG. 2, the mark CKV is the clock signal, and the marks $GS_1$~$GS_n$ are signals on the gate lines $G_1$~$G_n$ respectively. Each of the signals $GS_1$~$GS_n$ provides a gate pulse (as indicated by the mark 202), and each gate pulse 202 is used for turning on the pixels 110 coupled to a corresponding gate line 110. If any of the pixels 110 are turned on, the timing controller 102 controls the source driver 104 to correspondingly output data voltages (not shown) to the pixels 110 which have been turned on by the control signal $CS_2$, so as to update the display data related to the aforementioned pixels 110.

In FIG. 2, the time period starting from the rising edge of the gate pulse 202 of the signal $GS_1$ to the falling edge of the gate pulse 202 of the signal $GS_n$ is the image updating period of the electrophoretic display panel 108. Since the pulse width of the gate pulses 202 is a predetermined pulse width (as shown in FIG. 2, the length of the enabling time of the gate pulses 202 is T), it can be seen that the time length of updating the display image of the electrophoretic display panel 108 is fixed. In addition, in the current display image updating technology, even though not all of the pixels 110 need to update the display data, the display data related to all of the pixels 110 will still be updated when a display image needs to be updated.

Although now the electrophoretic display apparatus has been well received among consumers because of convenience, the response time of the electrophoretic display apparatus was still so slow because of the limitation of the material characteristics of the electrophoretic display panel and the aforementioned formal display image updating technology. Thus, the market competence of the electrophoretic display apparatus will be affected.

BRIEF SUMMARY

The present invention relates to a method for updating a display image of an electrophoretic display panel, which can reduce the response time of updating display image of the electrophoretic display apparatus effectively, so as to improve the market competence of the electrophoretic display apparatus.

The present invention further relates to an electrophoretic display apparatus, which adopts the method mentioned above to operate.

The present invention provides a method for updating a display image of an electrophoretic display panel. The electrophoretic display panel has a plurality of gate lines, and each of the gate lines is coupled to a plurality of pixels. The method comprises: dividing the gate lines into a first group and a second group, wherein display data related to the pixels coupled to the gate lines of the first group need not to be updated, and display data related to at least one of the pixels coupled to the gate lines of the second group need to be updated; and providing a first type gate pulse to each gate line of the first group and providing a second type gate pulse to each gate line of the second group, wherein the second type gate pulse has a predetermined pulse width, and the pulse width of the first type gate pulse is shorter than the predetermined pulse width.

The present invention further provides an electrophoretic display apparatus. The electrophoretic display apparatus comprises an electrophoretic display panel, a gate driver and a timing controller. The electrophoretic display panel has a plurality of gate lines, and each of the gate lines is coupled to a plurality of pixels. The gate driver is coupled to the gate lines. The timing controller is configured for dividing the gate lines into a first group and a second group when a display image of the electrophoretic display panel needs to be updated. The display data related to pixels coupled to the gate lines of the first group need not to be updated. The display data related to at least one of the pixels coupled to the gate lines of the second group need to be updated. The timing controller is further configured for controlling the gate driver to provide a first type gate pulse to each gate line of the first group and controlling the gate driver to provide a second type gate pulse to each gate line of the second group. The second type gate pulse has a predetermined pulse width, and the pulse width of the first type gate pulse is shorter than the predetermined pulse width.

The present invention further provides another method for updating a display image of an electrophoretic display panel. The electrophoretic display panel has a plurality of gate lines, and each of the gate lines is coupled to a plurality of pixels. The method comprises: dividing the gate lines into a first group and a second group, wherein display data related to the pixels coupled to the gate lines of the first group need not to be updated, and display data related to at least one of the pixels coupled to the gate lines of the second group need to be updated; and providing a first type gate pulse to each gate line of the first group and providing a second type gate pulse to each gate line of the second group, wherein the pulse duration of the first type gate pulse is shorter than that of the second type gate pulse.

The present invention further provides another electrophoretic display apparatus. The electrophoretic display apparatus comprises an electrophoretic display panel, a gate driver and a timing controller. The electrophoretic display panel has a plurality of gate lines, and each of the gate lines is coupled to a plurality of pixels. The gate driver is coupled to the gate lines. The timing controller is configured for dividing the gate lines into a first group and a second group when a display image of the electrophoretic display panel needs to be updated. The display data related to the pixels coupled to the gate lines of the first group need not to be updated. The display data related to at least one of the pixels coupled to the gate lines of the second group need to be updated. The timing controller is further configured for controlling the gate driver to provide a first type gate pulse to each gate line of the first group and controlling the gate driver to provide a second type gate pulse to each gate line of the second group. The pulse duration of the first type gate pulse is shorter than that of the second type gate pulse.

The present invention further provides another method for updating a display image of an electrophoretic display panel. The electrophoretic display panel has a plurality of gate lines, and each of the gate line is coupled to a plurality of pixels. The method comprises: providing a variety of gate pulses to the gate lines when a display image needs to be updated, so as to enable a first gate line to receive a first type gate pulse having a pulse duration which is shorter than the pulse duration of a second type gate pulse received by the second gate line, wherein display data related to the pixels coupled to the first gate line need not to be updated, and display data related to at least one of the pixels coupled to the second gate line need to be updated.

The present invention further provides another electrophoretic display apparatus. The electrophoretic display apparatus comprises an electrophoretic display panel, a gate driver and a timing controller. The electrophoretic display panel has a plurality of gate lines, and each of the gate lines is coupled to a plurality of pixels. The gate driver is coupled to the gate lines. The timing controller is configured for providing a variety of gate pulses which have different pulse durations to the gate lines when a display image of the electrophoretic display panel needs to be updated, so as to enable a first gate line to receive a first type gate pulse having a pulse duration which is shorter than the pulse duration of a second type gate pulse received by the second gate line. The display data related to the pixels coupled to the first gate line need not to be updated. And the display data related to at least one of the pixels coupled to the second gate line need to be updated.

In one embodiment of the present invention, when the first type gate pulse is provided to each gate line of the first group, a data voltage which is equal to a common electrode voltage is provided to the corresponding pixels of the gate lines driven by the first type gate pulse.

In one embodiment of the present invention, a clock cycle of a clock signal provided to the gate driver is adjusted, so that the gate driver can generate the first type gate pulse and the second type gate pulse according to the clock cycle to provide the first type gate pulse and the second type gate pulse to the gate lines.

In the present invention, when a display image of the electrophoretic display panel needs to be updated, the gate lines of the electrophoretic display panel are divided into a first group and a second group at first, wherein display data related to the pixels coupled to the first gate line need not to be updated, and display data related to at least one of the pixels coupled to the second gate line need to be updated. The predetermined pulse width of the gate pulses provided to each gate line of the second group is kept, and the pulse width of the gate pulses provided to each gate line of the first group is shorter than the predetermined pulse width. If the updating operation of the display image is performed in accordance with the method mentioned above, the response time of updating display image of the electrophoretic display apparatus can be reduced effectively. Furthermore, the market competence of the electrophoretic display apparatus can also be improved.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The present invention provides a method used for updating a display image of an electrophoretic display apparatus, the method will be illustrated in the following description by using the structure of the electrophoretic display apparatus shown in FIG. 1. It should be noted firstly that the operation manner of the electrophoretic display apparatus illustrated in the following description is different from the operation manner of the electrophoretic display apparatus illustrated in the prior art. Please refer to the following description related to the new method.

Figure 3:
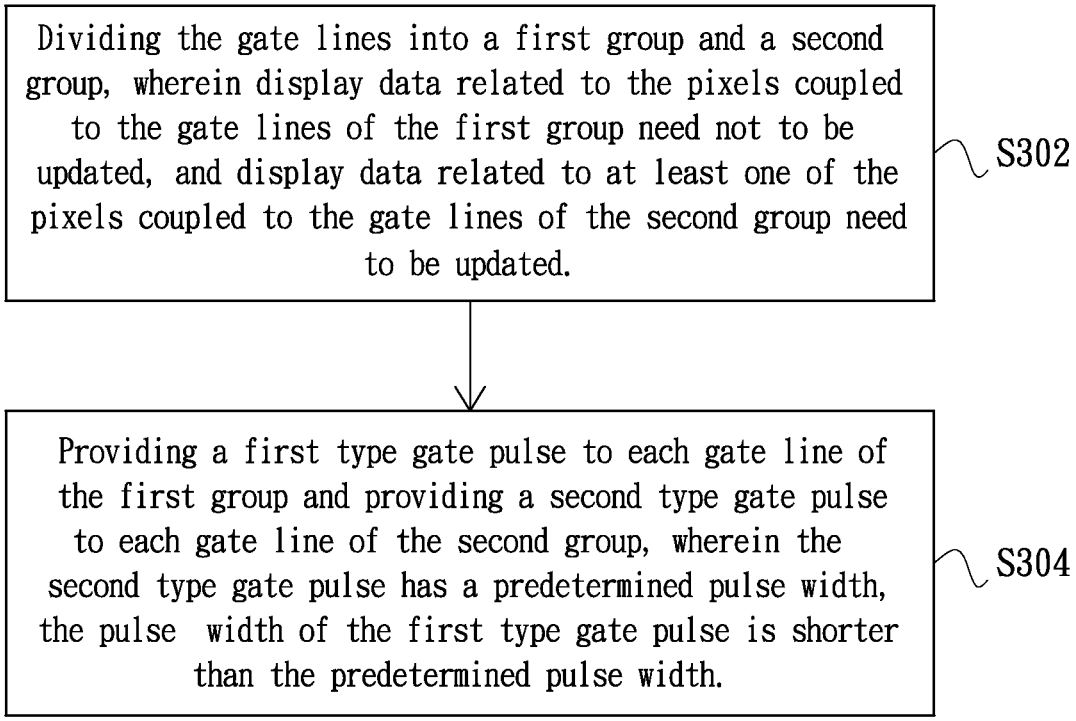
FIG. 3 is a flow chart of a method for updating a display image of an electrophoretic display panel according to an embodiment of the present invention.
Figure 4:
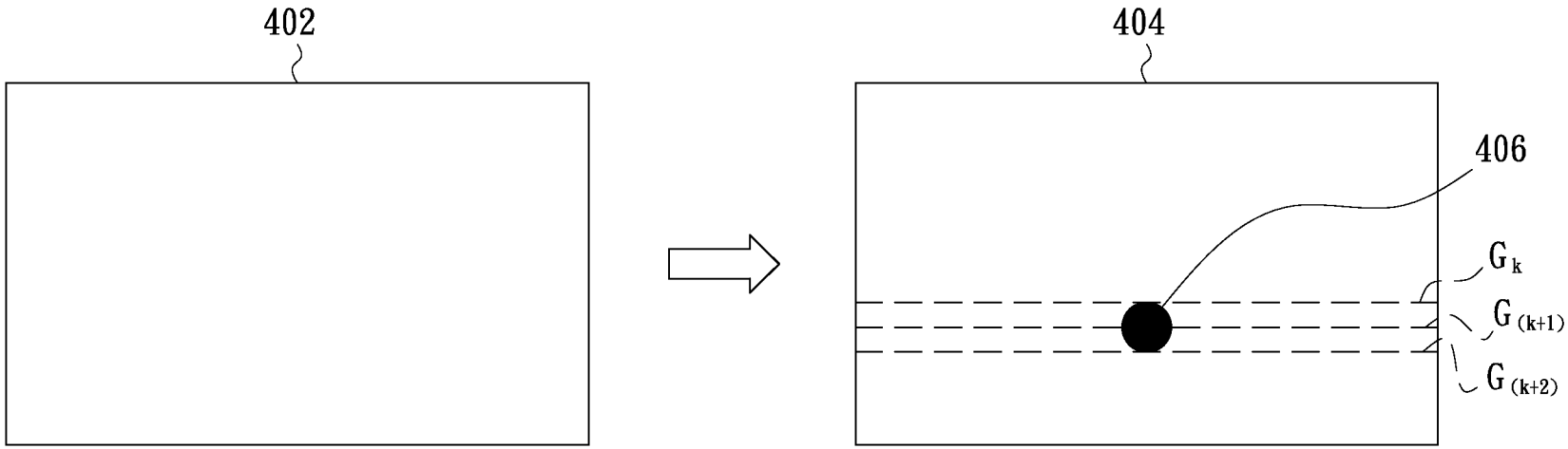
FIG. 4 shows the difference between a current image frame and a next image frame.

FIG. 3 is a flow chart of a method for updating a display image of an electrophoretic display panel according to an embodiment of the present invention. Referring to FIG. 1 and FIG. 3, the new operation method of the electrophoretic display apparatus 100 will now be described. When a display image displayed on the electrophoretic display panel 108 needs to be updated, for example, as shown in FIG. 4, a display image needs to be updated to display an image frame 404 (i.e., the next image frame) of the display image to substitute for an image frame 402 (i.e., the current image frame) of the display image, the electrophoretic display apparatus 100 will operate in accordance with the steps described in FIG. 3. This will be further described in the following description.

Since the difference between the image frame 402 and the image frame 404 is that the image frame 404 has a dot 406 and the dot 406 is displayed by a part of the pixels 110 coupled to the gate lines $G_k$~$G_{(k+2)}$, the timing controller 102 can divide the gate lines $G_1$~$G_n$ into two groups according to the difference between the display data related to the pixels of the image frame 402 and the image frame 404, wherein k is smaller than n. A first group of the gate lines consists of the gate lines $G_1$~$G_{(k-1)}$ and $G_{(k+3)}$~$G_n$, and the display data related to the pixels coupled to the gate lines of the first group need not to be updated; a second group of the gate lines consists of the gate lines $G_k$~$G_{(k+2)}$, and display data related to at least one of the pixels coupled to the gate lines of the second group need to be updated (step S302 of FIG. 3).

Figure 5:
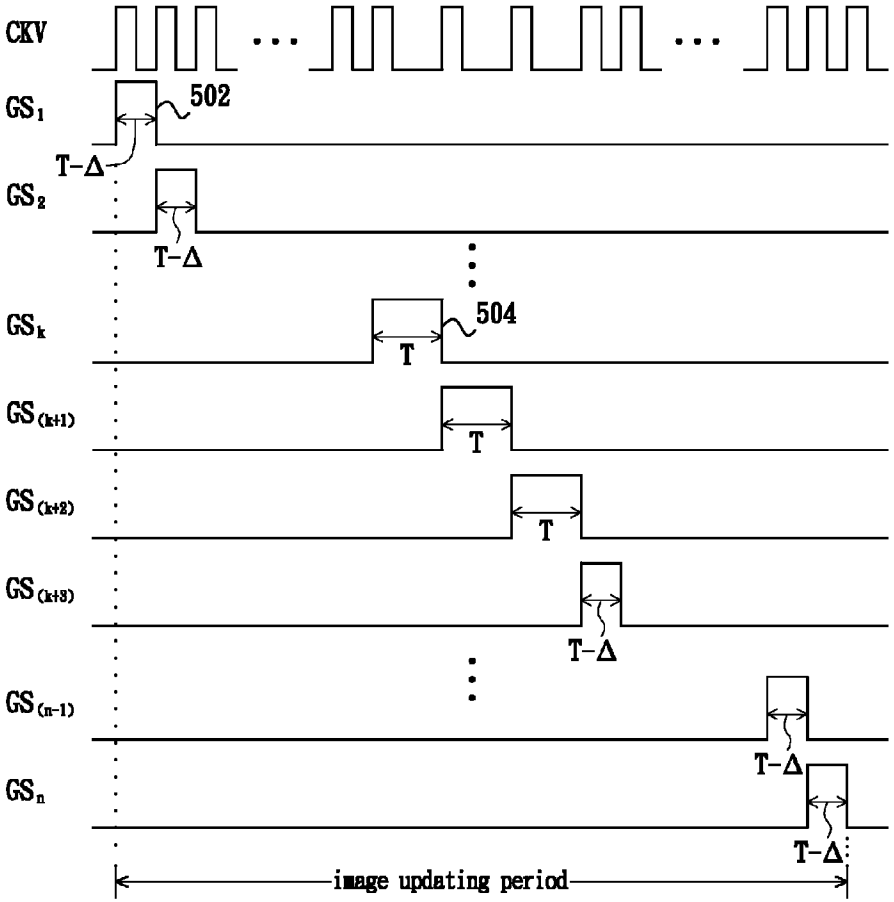
FIG. 5 shows a timing diagram of the gate pulses employed in one embodiment of the present invention.

When the step 302 has been executed, the timing controller 102 controls the gate driver 106 to output gate pulses of two different types to the gate lines $G_1$~$G_n$ by the clock signal CKV and the control signal $CS_1$, so as to transmit the gate pulses to the electrophoretic display panel 108 through the gate lines $G_1$~$G_n$. FIG. 5 shows the gate pulses. In FIG. 5, the mark CKV is the clock signal outputted by the timing controller 102, and the marks $GS_1$~$GS_n$ are signals on the gate lines $G_1$~$G_n$ respectively. Each of the signals $GS_1$~$GS_{(k-1)}$ and $GS_{(k+3)}$~$GS_n$ provides a first type gate pulse (as indicated by the mark 502), and each of the signals $GS_k$~$GS_{(k+2)}$ provides a second type gate pulse (as indicated by the mark 504). As shown in FIG. 5, in this embodiment, the timing controller 102 can adjust the clock cycle of the clock signal CKV provided to the gate driver 106, so that the gate driver 106 can generate the first type gate pulses 502 and the second type gate pulses 504 according to the adjusted clock cycle to provide the first type gate pulses 502 and the second type gate pulses 504 to the gate lines $G_1$~$G_n$.

Each second type gate pulse 504 has a predetermined pulse width, and the pulse width of the first type gate pulses 502 is shorter than the predetermined pulse width. As shown in FIG. 5, the length of the enabling time of the second type gate pulses 504 is T, and the length of the enabling time of the first type gate pulses 502 is T−Δ. In other words, the pulse duration of the first type gate pulses 502 is shorter than that of the second type gate pulses 504. It can be seen from FIG. 5 obviously that the first type gate pulses 502 are all provided to the gate lines of the first group, and the second type gate pulses 504 are all provided to the gate lines of the second group (step S304 of FIG. 3).

Figure 1:
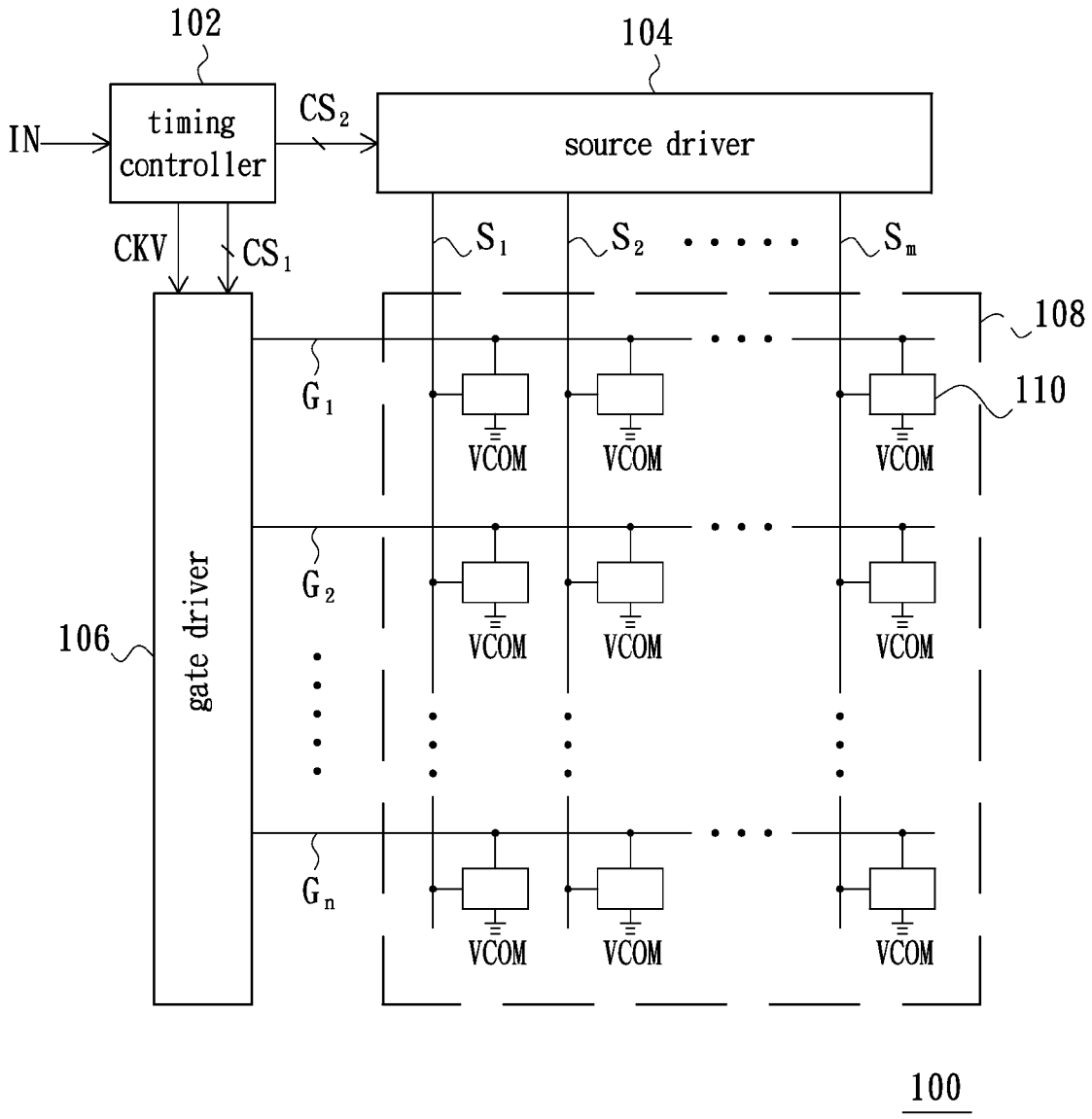
FIG. 1(Prior Art)
FIG. 1 is a schematic diagram of an electrophoretic display apparatus.
Figure 2:
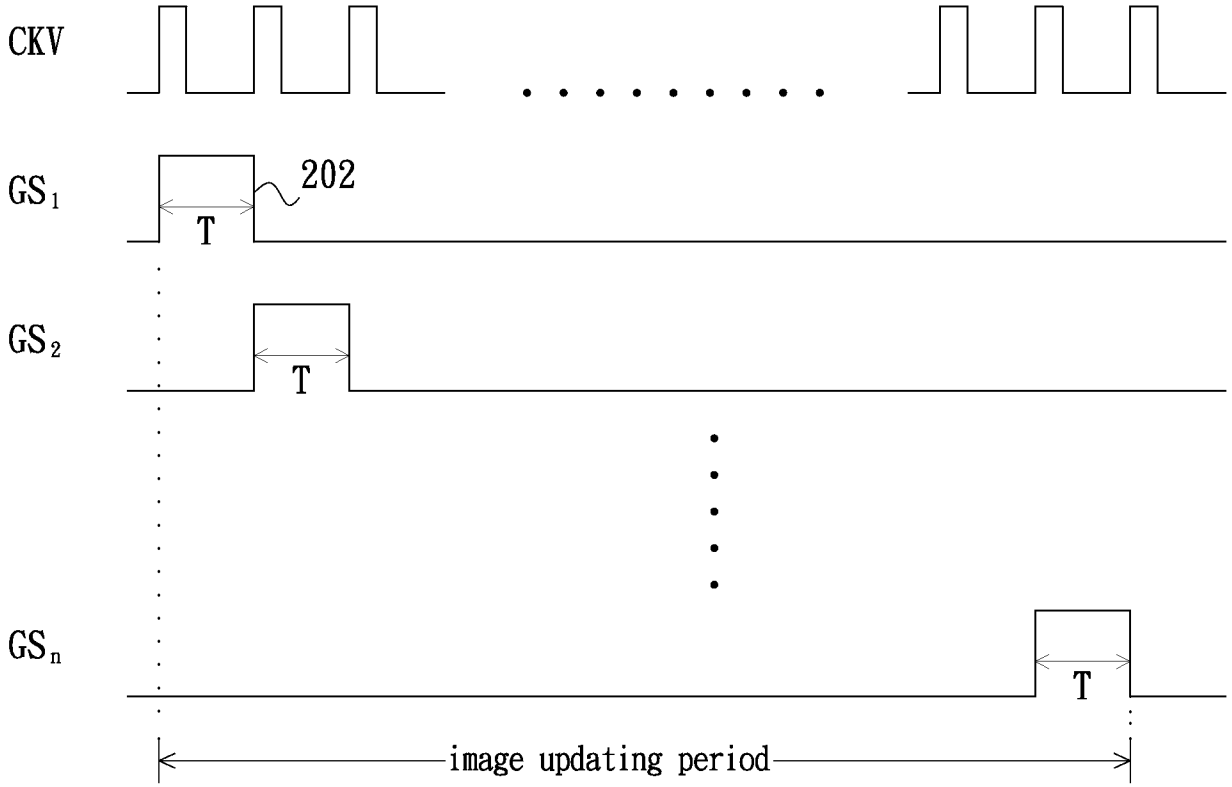
FIG. 2(Prior Art)
FIG. 2 shows a timing diagram of the gate pulses employed in the prior art.

Referring to FIG. 1 and FIG. 5, since the moving directions of the charged pigment particles in the electrophoretic fluid of each pixel 110 are determined according to the electric field between the common electrode voltage VCOM and the position where the pixel 110 is coupled to a corresponding source line, the timing controller 102 controls the source driver 104 to provide a data voltage which is equal to the common electrode voltage VCOM to the corresponding pixels turned on by the first type gate pulses 502 by the control signal $CS_2$ when the timing controller 102 controls the gate driver 106 to provide the first type gate pulses 502 to the gate lines of the first group, so as to prevent the pixels coupled to the gate lines $G_1$~$G_{(k-1)}$ and $G_{(k+3)}$~$G_n$ (i.e., the gate lines of the first group) from being loaded wrong data voltage to affect the loaded display data when performing the updating operation. For example, when the pixels 110 coupled to the gate line $G_1$ are turned on by the first type gate pulse 502, the timing controller 102 controls the source driver 104 to provide a data voltage which is equal to the common electrode voltage VCOM to the pixels 110 which have been turned on, so as to prevent the display data related to the pixels 110 from being affected. As to the pixels 110 coupled to the gate lines $G_k$~$G_{(k+2)}$, the display data related to these pixels 110 will be updated according to the conventional art.

Referring to FIG. 5, the time period starting from the rising edge of the gate pulse 502 of the signal $GS_1$ to the falling edge of the gate pulse 502 of the signal $GS_n$ is the image updating period of the electrophoretic display panel 108. Since only the pulse width of the second type gate pulses 504 of the signals $GS_k$~$GS_{(k+2)}$ is the predetermined pulse width and the pulse width of the other gate pulses is shorter than the predetermined pulse width, it can be seen that the time length of updating the display image of the electrophoretic display panel 108 adopting the updating method provided by the present invention can be shorter than the time length of updating the display image of the electrophoretic display panel 108 adopting the updating method provided by the conventional art. In other words, the new updating method provided by the present invention may reduce the response time of updating the display image of the electrophoretic display apparatus to accelerate the response time of the electrophoretic display apparatus.

In addition, from the description mentioned above, the art of updating the display image provided by the present invention is not to update the display data related to all the pixels but to update the display data related to the pixels which need to perform the operation of updating the display data. Furthermore, in the present invention, it can also be seen that the time length of updating the display image of the electrophoretic display panel is absolutely not fixed. In fact, the time length may be changed dynamically.

According to the teachings of the above embodiments, it can be seen from another point of view that the present invention is to provide a variety of gate pulses which have different pulse durations to the gate lines $G_1$~$G_n$ when an updating operation of the display image is performed, so as to enable a first gate line of the gate lines $G_1$~$G_n$ to receive a first type gate pulse having a pulse duration which is shorter than the pulse duration of a second type gate pulse received by a second gate line of the gate lines $G_1$~$G_n$, wherein the pixels coupled to the first gate line need not to update the display data, and in the pixels coupled to the second gate line, at least one pixel needs to update the display data.

To sum up, in the present invention, when a display image of the electrophoretic display panel needs to be updated, the gate lines of the electrophoretic display panel are divided into a first group and a second group at first, wherein the pixels coupled to the first gate line need not to update the display data, and in the pixels coupled to the second gate line, at least one pixel needs to update the display data. Afterward, the predetermined pulse width of the gate pulses provided to each gate line of the second group is kept, and the pulse width of the gate pulses provided to each gate line of the first group is kept to be shorter than the predetermined pulse width. If the updating operation of the display image is performed in accordance with the method mentioned above, the response time of updating display image of the electrophoretic display apparatus can be reduced effectively. Furthermore, the market competence of the electrophoretic display apparatus can also be improved.

In addition, since the response speed of the electrophoretic display apparatus provided by the present invention is faster, the electrophoretic display apparatus is highly suitable to cooperate with the touch technology to achieve the touch control function.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A method for updating a display image of an electrophoretic display panel, the electrophoretic display panel having a plurality of gate lines and a gate driver, each of the gate lines being coupled to a plurality of pixels and the gate driver, the method comprising:

dividing the gate lines into a first group and a second group, wherein display data relates to the pixels coupled to the gate lines of the first group need not to be updated, and display data relates to at least one of the pixels coupled to the gate lines of the second group need to be updated; and providing a first type gate pulse to each gate line of the first group and providing a second type gate pulse to each gate line of the second group, wherein the second type gate pulse has a predetermined pulse width, and a pulse width of the first type gate pulse is shorter than the predetermined pulse width, and the first type gate pulse and the second type gate pulse are obtained by adjusting the clock cycle of a clock signal provided to the gate driver.

2. The method as claimed in claim 1, wherein dividing the gate lines into a first group and a second group is performed according to the difference between the display data of a current image frame of the display image and the display data of a next image frame of the display image next to the current image frame.

3. The method as claimed in claim 1, wherein when the first type gate pulse is provided to each gate line of the first group, a data voltage which equals to a common electrode voltage is provided to the corresponding pixels coupled to the gate line being driven by the first type gate pulse.

4. The method as claimed in claim 3, wherein the common electrode voltage is an alternating voltage.

5. The method as claimed in claim 1, wherein a clock cycle of a clock signal provided to a gate driver is adjusted so that the gate driver generates the first type gate pulse and the second type gate pulse according to the clock cycle and provides the first type gate pulse and the second type gate pulse to the gate lines.

6. The method as claimed in claim 1, wherein the first type gate line and the second type gate pulse are provided to each gate line of the first group and the second group in the same frame during showing the display image.

7. An electrophoretic display apparatus comprising:

an electrophoretic display panel, having a plurality of gate lines, each of the gate lines being coupled to a plurality of pixels;

a gate driver, coupled to the gate lines; and a timing controller, being configured for dividing the gate lines into a first group and a second group when a display image of the electrophoretic display panel needs to be updated, wherein display data relates to the pixels coupled to the gate lines of the first group need not to be updated, and display data relates to at least one of the pixels coupled to the gate lines of the second group need to be updated, the timing controller further being configured for controlling the gate driver to provide a first type gate pulse to each gate line of the first group by adjusting the clock cycle of a clock signal provided to the gate driver, and controlling the gate driver to provide a second type gate pulse to each gate line of the second group by adjusting the clock cycle of the clock signal, the second type gate pulse has a predetermined pulse width, and the pulse width of the first type gate pulse is shorter than the predetermined pulse width.

8. The electrophoretic display apparatus as claimed in claim 7, wherein the timing controller divides the gate lines into the first group and the second group according to the difference between the display data of a current image frame and the display data of a next image frame next to the current image frame.

9. The electrophoretic display apparatus as claimed in claim 7, further comprising:

a source driver, wherein when the timing controller controls the gate driver to provide the first type gate pulse to each gate line of the first group, the timing controller further controls the source driver to provide a data voltage which is equal to a common electrode voltage to the corresponding pixels coupled to the gate line being driven by the first type gate pulse.

10. The electrophoretic display apparatus as claimed in claim 9, wherein the common electrode voltage is an alternating voltage.

11. The electrophoretic display apparatus as claimed in claim 7, wherein a clock cycle of a clock signal provided to a gate driver is adjusted by the timing controller, and the timing controller controls the gate driver to generate the first type gate pulse and the second type gate pulse according to the clock cycle to provide the first type gate pulse and the second type gate pulse to the gate lines.

12. The electrophoretic display apparatus as claimed in claim 7, wherein the first type gate line and the second type gate pulse are provided to each gate line of the first group and the second group in the same frame during showing the display image.

13. A method for updating a display image of an electrophoretic display panel, the electrophoretic display panel having a plurality of gate lines and a gate driver, each of the gate lines being coupled to a plurality of pixels and the gate driver, the method comprising:

dividing the gate lines into a first group and a second group, wherein display data related to the pixels coupled to the gate lines of the first group need not to be updated, and display data related to at least one of the pixels coupled to the gate lines of the second group need to be updated; and providing a first type gate pulse to each gate line of the first group and providing a second type gate pulse to each gate line of the second group, wherein the pulse duration of the first type gate pulse is shorter than that of the second type gate pulse, and the first type gate pulse and the second type gate pulse are obtained by adjusting the clock cycle of a clock signal provided to the gate driver.

14. The method as claimed in claim 13, wherein the first type gate line and the second type gate pulse are provided to each gate line of the first group and the second group in the same frame during showing the display image.

15. An electrophoretic display apparatus, comprising:

an electrophoretic display panel, having a plurality of gate lines, each of the gate lines being coupled to a plurality of pixels;

a gate driver, coupled to the gate lines; and a timing controller, being configured for dividing the gate lines into a first group and a second group when a display image of the electrophoretic display panel needs to be updated, wherein display data related to the pixels coupled to the gate lines of the first group need not to be updated, and display data related to at least one of the pixels coupled to the gate lines of the second group need to be updated, the timing controller further being configured for controlling the gate driver to provide a first type gate pulse to each gate line of the first group by adjusting the clock cycle of a clock signal provided to the gate driver, and controlling the gate driver to provide a second type gate pulse to each gate line of the second group by adjusting the clock cycle of the clock signal, wherein the pulse duration of the first type gate pulse is shorter than that of the second type gate pulse.

16. The electrophoretic display apparatus as claimed in claim 15, wherein the first type gate line and the second type gate pulse are provided to each gate line of the first group and the second group in the same frame during showing the display image.

17. A method for updating a display image of an electrophoretic display panel, the electrophoretic display panel having a plurality of gate lines and a gate driver, each of the gate lines being coupled to a plurality of pixels and the gate driver, the method comprising:

providing a variety of gate pulses to the gate lines when a display image needs to be updated so as to enable a first gate line to receive a first type gate pulse having a pulse duration which is shorter than the pulse duration of a second type gate pulse received by the second gate line, wherein the first type gate pulse and the second type gate pulse are obtained by adjusting the clock cycle of a clock signal provided to the gate driver, display data related to the pixels coupled to the first gate line need not to be updated, and display data related to at least one of the pixels coupled to the second gate line need to be updated.

18. The method as claimed in claim 17, wherein the first type gate line and the second type gate pulse are provided to each gate line of the first group and the second group in the same frame during showing the display image.

19. An electrophoretic display apparatus, comprising:

an electrophoretic display panel, having a plurality of gate lines, each of the gate lines being coupled to a plurality of pixels;

a gate driver, coupled to the gate lines; and a timing controller, being configured for controlling the gate driver to provide a variety of gate pulses to the gate lines by adjusting the clock cycle of a clock signal provided to the gate driver when a display image of the electrophoretic display panel needs to be updated, so as to enable a first gate line to receive a first type gate pulse having a pulse duration which is shorter than the pulse duration of a second type gate pulse received by the second gate line, wherein display data related to the pixels coupled to the first gate line need not to be updated, and display data related to at least one of the pixels coupled to the second gate line need to be updated.

20. The electrophoretic display apparatus as claimed in claim 19, wherein the first type gate line and the second type gate pulse are provided to each gate line of the first group and the second group in the same frame during showing the display image.

* * * * *